United States Patent [19]

League, IV

[11] 4,111,669

[45] Sep. 5, 1978

[54] MAGNETIC IMPULSE RAPPER CONTROL SYSTEM

[75] Inventor: John S. League, IV, Baltimore, Md.

[73] Assignee: Koppers Company, Inc., Pittsburgh, Pa.

[21] Appl. No.: 789,493

[22] Filed: Apr. 21, 1977

Related U.S. Application Data

[63] Continuation of Ser. No. 544,768, Jan. 28, 1975, abandoned.

[51] Int. Cl.[2] ..... B03C 3/00

[52] U.S. Cl. ..... 55/112; 55/105; 55/139; 323/22 SC; 323/23; 363/128

[58] Field of Search ..... 55/112, 105, 139; 323/22 SC, 23; 363/128

[56] References Cited

U.S. PATENT DOCUMENTS

| | | | |
|---|---|---|---|
| 2,016,531 | 10/1935 | Winkermute | 55/112 |
| 2,858,900 | 11/1958 | Foley | 55/112 |
| 3,469,371 | 9/1969 | Gelfand | 55/139 |
| 3,504,480 | 4/1970 | Copcutt et al. | 55/139 |
| 3,507,096 | 4/1970 | Hall et al. | 55/139 |
| 3,577,708 | 5/1971 | Drenning et al. | 55/105 |
| 3,873,282 | 3/1975 | Finch | 55/105 |
| 3,877,896 | 4/1975 | Muskovac | 55/105 |
| 4,008,057 | 2/1977 | Gelfand et al. | 55/112 |

*Primary Examiner*—Bernard Nozick

*Attorney, Agent, or Firm*—Herbert J. Zeh, Jr.; Oscar B. Brumback

[57] ABSTRACT

A controller for selectively energizing actuating coils of rappers of an electrostatic precipitator assembly to impart motion to a portion of the precipitator assembly and remove accumulated material therefrom. The controller intermittently supplies a d.c. potential to a rapper supply bus common to a plurality of rappers of the electrostatic precipitator assembly for time periods each of a predetermined duration. Switching means responsive to the d.c. potential selectively connect an actuating coil of at least one rapper of the plurality of rappers to the rapper supply bus during each of the time periods to energize the actuating coil of at least one rapper with the d.c. potential. In the preferred embodiment, the d.c. potential is supplied by an SCR controlled rectifying means and the switching means each comprise an SCR. Means are provided for selectively varying a time interval between the time periods during which the d.c. potential is supplied to the rapper supply bus so that the rapping intervals may be varied. One or more rapper fields may be connected to a supply bus as desired.

23 Claims, 8 Drawing Figures

MAGNETIC IMPULSE RAPPER CONTROL SYSTEM

This is a continuation, of application Ser. No. 544,768, filed Jan. 28, 1975 now abandoned.

BACKGROUND OF THE INVENTION

This invention relates to rapping systems for electrostatic precipitators and, more particularly, to a novel rapper control system and rapper assembly for electrostatic precipitators.

In a typical electrostatic precipitator assembly, particle laden gas is passed through a series of stages or fields of the precipitator and particles such as dust or ash are electrostatically attracted to precipitator plates. The gas becomes progressively cleaner as it passes through each stage until, at the output end of the precipitator, relatively clean gas is discharged.

As material such as ash accumulates on the plates and electrodes of the precipitator, there is a decrease in the collecting efficiency of the precipitator. Accordingly, rappers are typically employed to impart mechanical vibration to the plates and electrodes so that the accumulated material drops into a collection bin or hopper out of the gas flow path. Rapping is thus quite important to the continued efficient operation of electrostatic precipitators.

Numerous ways of controlling the rappers in a precipitator have been devised and include various mechanically and electrically actuated circuits. Typically, such circuits require extremely high voltage power supplies and/or energy storage means in order to provide the requisite electrical current to the rappers to generate the desired intensity of rapper impact. Moreover, various complicated and thus quite costly schemes of control have been devised to ensure rapping in the various precipitator stages or fields with the appropriate frequency. Such systems may, for example, be linked to some precipitator operating parameter such as sparking rate in order to provide the appropriate rapping frequencies for the various precipitator fields.

It is an object of the present invention to provide a novel rapper controller for selectively energizing rappers of an electrostatic precipitator assembly in a manner which overcomes these and other problems of prior art rapping systems.

It is another object of the present invention to provide a novel controller for selectively energizing rappers of an electrostatic precipitator from available a.c. line voltage.

It is a further object of the present invention to provide a novel controller for energizing rappers of an electrostatic precipitator from an a.c. supply through the application of a rectified d.c. potential to a rapper supply bus common to a plurality of rappers and through the selective connection of the rappers between the rapper supply bus and a common return bus over the time period during which the d.c. potential is supplied to the rapper supply bus.

It is yet another object of the present invention to provide a controller for selectively energizing rappers of an electrostatic precipitator assembly wherein the controller is electronically operated and comprised primarily of solid state devices.

These and many other objects and advantages of the present invention will be readily apparent to one skilled in the art to which the invention pertains from the following detailed description when read in conjunction with the appended drawings.

DETAILED DESCRIPTION

Figure 1:
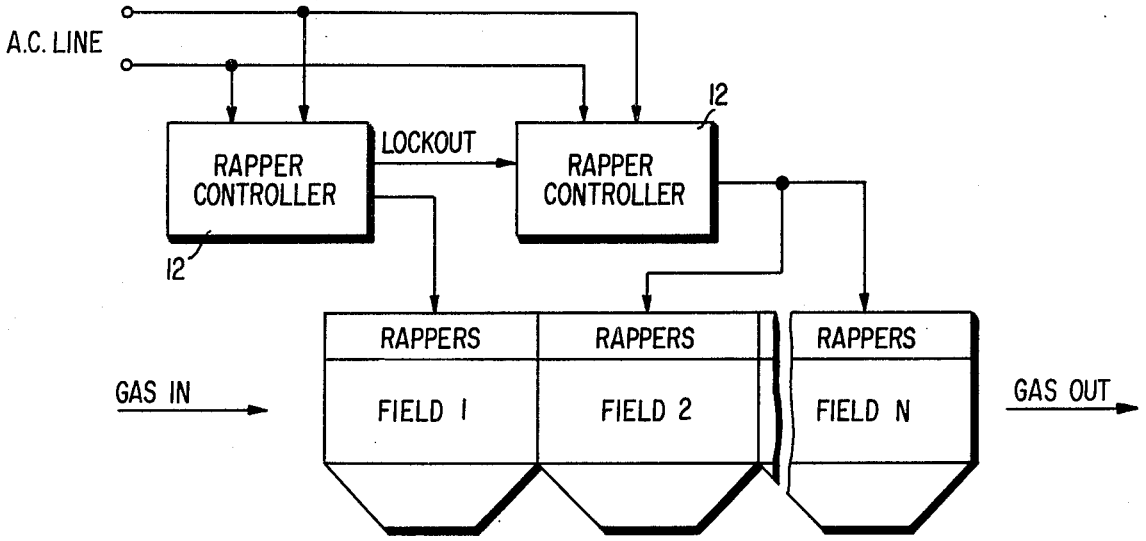
FIG. 1 is a schematic illustration of an electrostatic precipitator assembly illustrating one manner in which the rapper controllers in accordance with the present invention may be employed to energize the rappers of a multiple field precipitator.

FIG. 1 schematically illustrates a multiple field electrostatic precipitator employing a rapping system in accordance with the present invention. With reference now to FIG. 1, the precipitator may include several fields or stages designated Field 1 - Field N through which gas containing particulate or other removable material is passed. The material in the gas is collected on precipitator plates as the gas passes through the precipitator in a well known manner.

The collection of material on the precipitator plates reduces the collecting efficiency of the precipitator. The collected material must therefore be periodically removed from the plates in order for the precipitator to function properly. In this regard, a plurality of rappers are typically employed to mechanically impact the supports to which the precipitator plates are connected. The rappers impart vibration to the plates and the material collected on the plates falls into a hopper or other suitable collecting container.

Control of the rappers is accomplished periodically in accordance with the present invention by one or more rapper controllers 12 described hereinafter in greater detail. The rapper controllers 12 receive power from the available a.c. line source, e.g. 220 or 440 volts a.c., and provide timed energizing signals to the rappers. As is shown in FIG. 1, a separate rapper controller 12 may be provided for each field or a single rapper controller may provide energizing signals for a plurality of fields. Where several rapper controllers are employed in a single precipitator assembly, a lockout signal may be provided between the rapper controllers so as to prevent the energization of rappers in more than one field at any particular instant.

Figure 2:
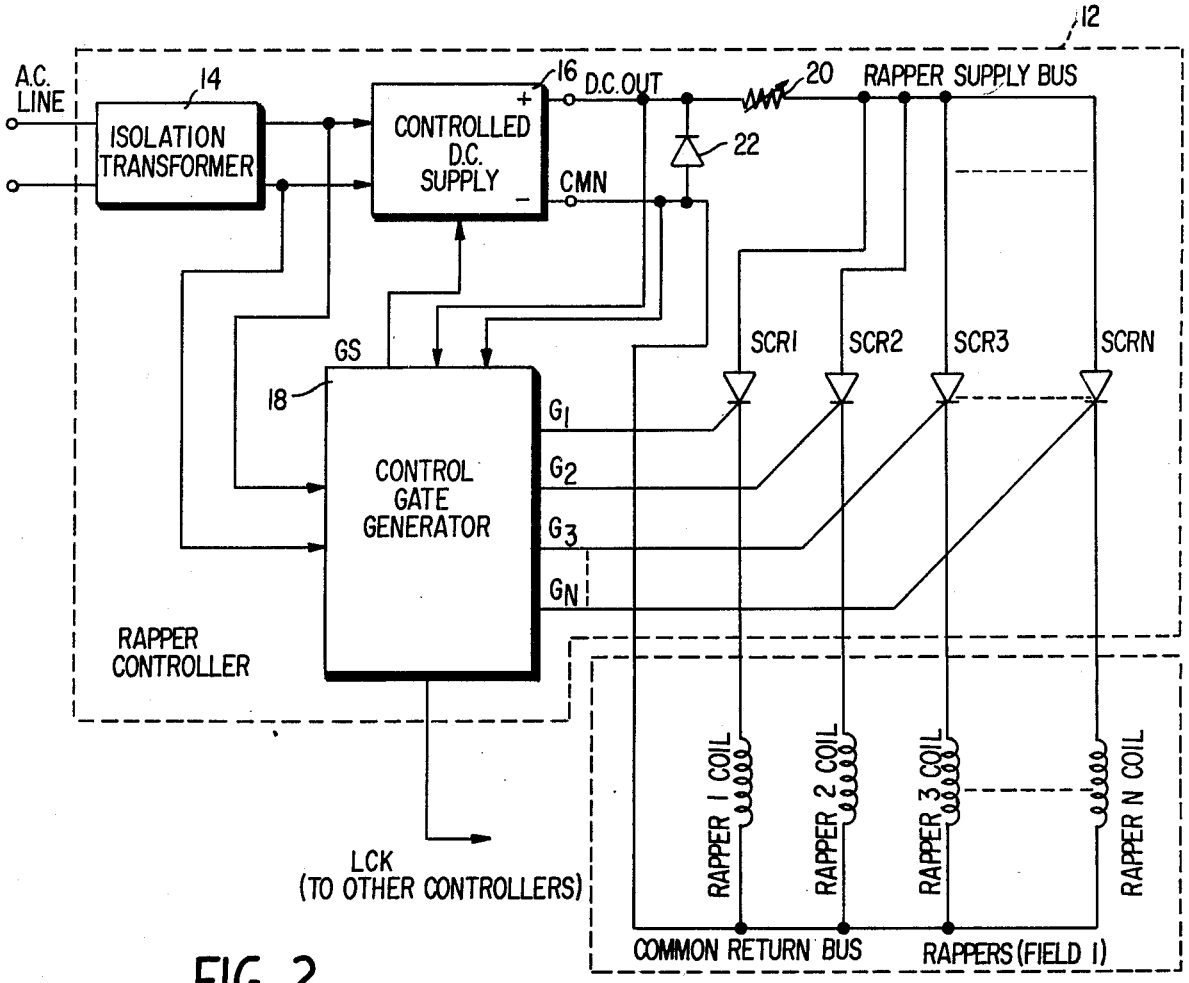
FIG. 2 is a functional block diagram generally illustrating a preferred form of the rapper controlier of FIG. 1.

A rapper controller in accordance with the present invention is generally illustrated in FIG. 2. Referring now to FIG. 2, the a.c. line voltage is supplied through an isolation transformer 14 both to a controlled d.c. supply 16 and to a control gate generator 18. The controlled d.c. supply 16 rectifies the a.c. line voltage and provides a d.c. potential between a d.c. output terminal DCOUT and a common terminal CMN. The d.c. output terminal of the supply 16 is connected through a current limiting resistor 20 to a rapper supply bus common to a plurality of rappers. Control of current to the rappers may be accomplished through the use of a variable current limiting resistor 20 or as described hereinafter.

Each of the rappers includes a rapper coil designated Rapper 1 Coil - Rapper N Coil in FIG. 2. Each rapper coil is connected between a common return bus and the rapper supply bus through an associated silicon controlled rectifier SCR 1-SCR N. The common return bus is connected to the common output terminal of the controlled d.c. supply 16 and a reverse poled, freewheeling diode 22 is connected between the common and d.c. output terminals of the supply 16 to provide a path for any current flow which continues in the rapper coil after the control voltage is removed.

The d.c. output and common terminals of the supply 16 are connected to the control gate generator 18 and a periodically generated power supply gating signal GS is supplied from the control gate generator 18 to the controlled d.c. supply 16. Gating signals $G_1$-$G_n$ are supplied to the control electrodes of the respective silicon controlled rectifiers SCR 1-SCRN from the control gate generator 18. The control gate generator 18 also supplies a lockout signal LCK to other rapper controllers employed in conjunction with the precipitator assembly.

In operation, the controlled d.c. supply 16 receives the a.c. line voltage through the isolation transformer 14 and, in response to the gating signals GS. supplies a d.c. output voltage to the rapper supply bus over a predetermined period of time. As will become apparent hereinafter, the gating signal GS may include one or more distinct signals for triggering electronic switches in the d.c. supply 16. Moreover, the gating signal GS is preferably synchronized with the a.c. line voltage so as to trigger the electronic switches in a desired time relationship with the zero cross-over points of the a.c. line voltage.

The d.c. output voltage is also supplied to the control gate generator 18 to generate the gating signals $G_1$-$G_n$ as will be explained hereinafter. While the d.c. output voltage is present on the rapper supply bus, a selected one of the SCRs is triggered by its associated gating signal $G_1$-$G_n$ and the d.c. voltage on the rapper supply bus is supplied through one or more of the rapper coils to actuate that rapper. When the d.c. voltage from the supply 16 is removed at the end of the predetermined time period, the conducting one or more of the SCRs becomes nonconductive. Thereafter, the d.c. output voltage from the controlled d.c. supply 16 may be again supplied to the rapper supply bus for the predetermined period of time and one or more of the other rapper coils may be energized through the generation of others of the gating signals $G_1$-$G_n$. As will become apparent, the control gate generator 18 generates the gating signals $G_1$-$G_n$ and GS in a timed sequence so as to cyclically energize each of the rappers of a particular field.

In order to insure that rappers in two fields are not simultaneously energized, the lockout signal LCK may be supplied to other rapper controllers during the predetermined period of the gating signal GS so as to inhibit operation of the rappers by these other controllers. Moreover, the frequency of energization of the rappers in any particular field may be controlled by controlling the frequency of generation of the gating signals GS and $G_1$-$G_n$ to meet the differing rapping needs in the various precipitator fields. To further meet the various rapping needs which may be encountered in the different precipitator fields, the gating signal GS may be controlled so as to control the intensity of rapping by the control of the d.c. output from the supply 16.

Figure 3:
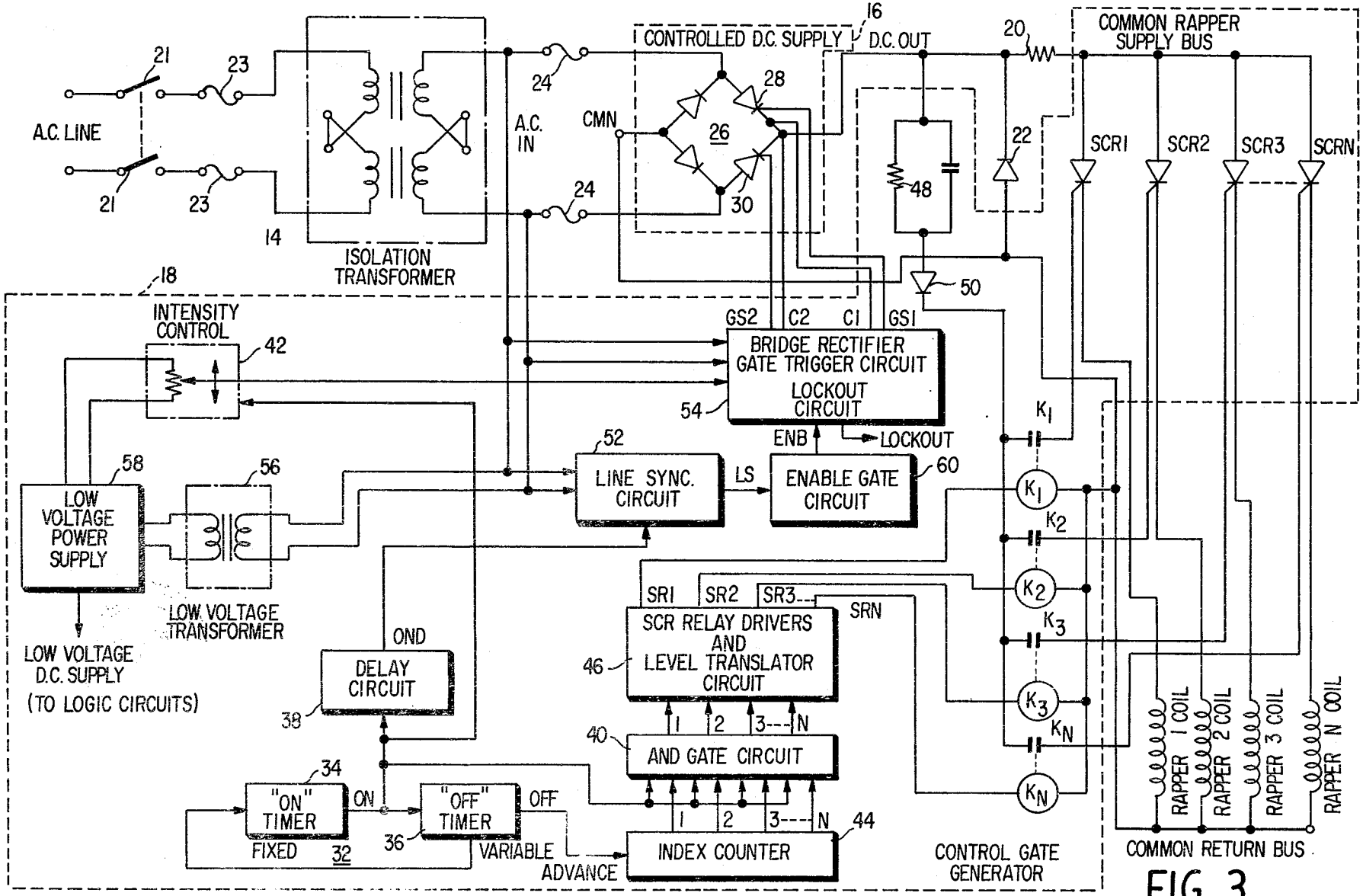
FIG. 3 is a functional block diagram illustrating the rapper controller of FIGS. 1 and 2 in greater detail.

One embodiment of the rapper controller 12 of FIGS. 1 and 2 is illustrated in greater detail in FIG. 3 to facilitate an understanding of the invention. Referring now to FIG. 3, the a.c. line voltage may be supplied through an on/off switch 21 and suitable overload protection devices 23 to a suitable conventional isolation transformer such as the illustrated 1:1 transformer. The output voltage from the transformer 14 may be applied through suitable conventional overload protection devices 24 to the controlled d.c. supply 16 as the a.c. input thereto. The controlled d.c. supply 16 may comprise a full wave bridge rectifying circuit 26 having silicon controlled rectifiers 28 and 30 in two legs thereof. The positive or d.c. output terminal DCOUT of the supply 16 may be connected through the current limiting resistor 20 to the common rapper supply bus and the common or negative output terminal CMN of the supply 16 may be connected to the common return bus as described previously.

The control gate generator 18 provides gating signals to the controlled d.c. supply 16 and to the silicon controlled rectifiers SCR 1-SCR N under the control of a timing circuit generally indicated at 32. The timing circuit 32 preferably includes a suitable conventional fixed interval "on" timer 34 and a suitable conventional variable interval "off" timer 36. An output pulse from the on timer is supplied to an input terminal of the off timer 36, to a suitable conventional delay circuit 38, to an AND gate circuit 40 and to a suitable intensity control circuit 42. An output signal from the off timer 36 is supplied to an input terminal of the on timer 34 and an advance pulse from the off timer 36 is applied to an input terminal of an index counter 44.

A decoded output signal from the index counter 44 is supplied to the AND gate circuit 40 and the output signal 1-N from the AND gate 40 are supplied to a suitable conventional SCR relay driver and level translator circuit 46. Output signals SR1-SRn from the SCR relay driver and level translator circuit 46 are applied through relay coils K1-KN associated with respective like-designated relay contacts K1-KN. The d.c. output voltage from the controlled d.c. supply 16 is supplied through a parallel RC circuit 48 and a diode 50 to one side of each of the normally open relay contacts K1-KN. The other side of each of the normally open contacts K1-KN is connected to the gate electrode of an associated one of the silicon controlled rectifiers SCR 1-SCR N.

The a.c. voltage from the secondary winding of the isolation transformer 14 is supplied to a line sync circuit 52, to a bridge rectifier gate trigger circuit 54 and to a low voltage transformer 56. The output signal from the low voltage transformer 56 is applied to a conventional low voltage power supply 58 which supplies low voltage d.c. to all of the logic circuits and supplies a d.c. signal to the intensity control circuit 42.

The output signal from the delay circuit 38 is supplied to the line sync circuit 52 and the output signal from the line sync circuit 52 is applied an enable gate circuit 60. The output signal from the enable gate circuit 60 is supplied to a lockout circuit in the bridge rectifier gate trigger circuit 54 and the output signal from the intensity control circuit 42 is supplied to the bridge rectifier gate trigger circuit 54. The bridge rectifier gate trigger circuit 54 in turn supplies gating signals GS1 and GS2 to the controlled d.c. supply 16. The signals GS1 and GS2 are supplied to the gate electrodes of the silicon controlled rectifiers 28 and 30 and are referenced to the cathode potential of the rectifiers 28 and 30 as indicated by the signal bias designated C1 and C2.

Figure 4:
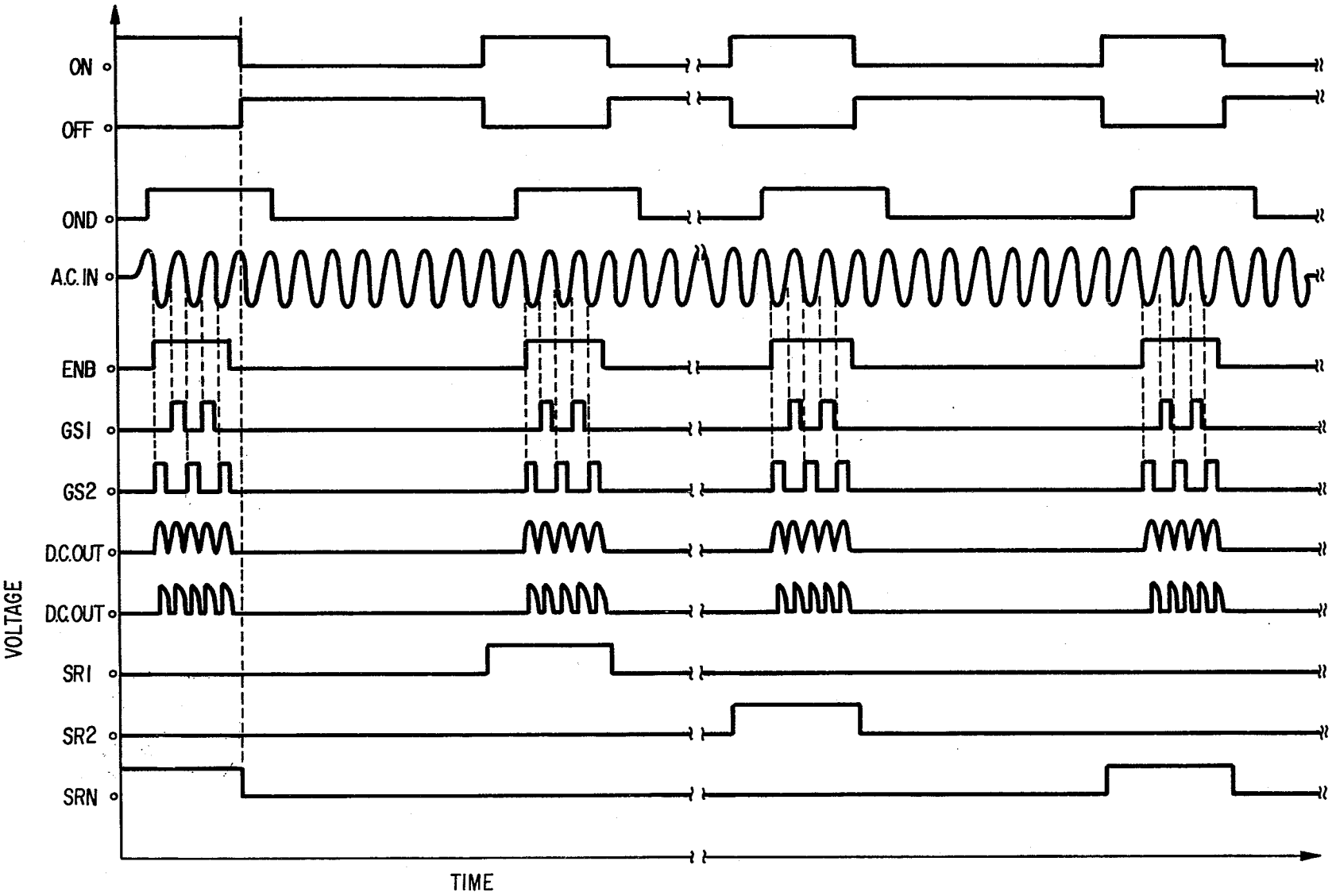
FIG. 4 is a series of waveforms illustrating exemplary signal waveforms of the circuit of FIG. 3 and exemplary time relationships therebetween.

The operation of the rapper control system illustrated in FIG. 3 may be more clearly understood with reference to FIG. 3 and to FIG. 4 wherein exemplary waveforms are illustrated. As can be seen in FIG. 4, the on timer 34 generates an ON pulse of a predetermined fixed duration which enables the AND gate circuit 40 and the intensity control circuit 42. The ON pulse also resets the off timer 36 and inhibits its operation during the period of the ON pulse.

The ON pulse is delayed by the delay circuit 38 to provide the ON delayed or OND signal to the line sync circuit 52. The line sync circuit 52 provides an output pulse LS at the first coincidence between the on delayed pulse OND and a zero cross-over point of the a.c. signal from the transformer 14, and this output pulse is supplied to the enable gate 60. The enable gate 60 then generates the enable signal ENB commencing at the zero cross-over point specified by the line sync pulse and having a predetermined duration, e.g. 43 milliseconds or approximately 5 half cycles of the a.c. input signal. The enable gate circuit 60 may, for example, comprise a monostable or one-shot multivibrator which, when triggered by the line sync pulse LS, generates a 43 millisecond enable pulse ENB.

The enable signal ENB is supplied to the lockout circuit in the bridge rectifier gate trigger circuit 54 and a lockout signal is supplied to the other rapper controllers in the precipitator assembly. The lockout signal may, for example, be applied to the on timer 34 in the other rapper controllers so as to prevent rapping during the duration of the lockout signal.

The lockout signal may also be utilized by the bridge rectifier gate trigger circuit 54 in conjunction with the a.c. input signal and the output signal from the intensity control circuit 42 to provide gating signals to the silicon controlled rectifiers 28 and 30 in the controlled d.c. supply 16. Specifically, the time period during which the enable signal ENB is at a high signal level (also the time interval of the lockout signal) determines a time interval during which d.c. potential is to be supplied to the common rapper supply bus. During this time interval, the bridge rectifier gate trigger circuit 54 generates a pulse at some time during each half cycle of the a.c. input signal to trigger the appropriate one of the SCRs 28 and 30. The time at which the gating signal is initiated during each half cycle, i.e. the phase angle of the gating signal relative to the zero cross-over point and therefore the conduction phase angle of the silicon controlled rectifiers 28 and 30, may be determined by the setting of the intensity control circuit 42 as is described in greater detail hereinafter. In FIG. 4, for example, the gating signals GS1 and GS2 are illustrated as being initiated coincident with the zero cross-over points of the a.c. input signal. Thus, each silicon controlled rectifier 28 and 30 conducts over the entire half cycle of the a.c. signal and the d.c. output signal (without considering any filtering effect) would be as illustrated in the upper DCOUT waveform of FIG. 4. If decreased rapping intensity is desired, the intensity control setting may be changed, thus changing the conduction phase angle of the SCRs 28 and 30 so as to produce less average d.c. output power as illustrated in the lower DCOUT waveform shown in FIG. 4. Alternatively, the value of the current limiting resistor 20 may be varied as was previously mentioned.

Since the ON pulse from the on timer 34 is delayed for a predetermined time (e.g. about 10 milliseconds) prior to being used in generating the gating signals GS1 and GS2, the AND gate circuit 40 is enabled prior to the generation of a d.c. output signal by the controlled d.c. supply 16. The index counter 44 is preferably an N stage shift register which cyclically shifts a binary ONE through the N stages thereof in response to OFF signal from the off timer 36. Assuming that the binary ONE is preset in the first stage of the index counter 44 when the ON pulse enables the AND gate circuit 40, the "1" signal is passed by the AND gate circuit 40 to the SCR 1 relay driver and level translator circuit 46 as an indication to trigger SCR 1 and thereby energize rapper number 1 coil. The "1" signal from the AND gate circuit 40 therefore results in the generation of the SCR 1 trigger signal SR 1 which in turn energizes the coil of relay K 1. Relay contact K 1 is thus held closed for the duration of the ON pulse in the on timer 34 (e.g. for about 70 milliseconds).

As soon as a d.c. output signal DCOUT is generated by the controlled d.c. supply 16 and supplied to the common rapper supply bus, a positive d.c. signal is passed by the RC circuit 48 through the diode 50 and through the closed relay contact K 1 to the gate electrode of SCR 1. The silicon control rectifier SCR 1 is thus triggered into conduction as soon as a d.c. output signal is applied to the common rapper supply bus. As soon as the d.c. output signal is removed from the common rapper supply bus, the conducting silicon controlled rectifier reverts to a nonconductive condition (assuming that any stored in the rapper coils has been dissipated through the free wheeling diode 22).

When the ON pulse reverts to a binary ZERO level at the end of the period of the on timer 34, the AND gate circuit 40 is inhibited and the off timer 36 advances the index counter to the next sequential count, e.g. shifts the binary ONE in the index shift register into the next stage. The next ON pulse will accordingly result in the generation of the next sequential SCR trigger signal, e.g. the SR 2 trigger signal, and in the application of a d.c. output signal to the common rapper supply bus for the predetermined time interval of the enabled gate ENB. This procedure continues successively until all N silicon controlled rectifiers have been triggered and thus all in rappers coils have been energized. The index counter 44 then recycles to the first position and the cycle starts again from position "1".

It should be noted that while the time interval of the on timer 34 is preferably fixed, the time interval of the off timer 36 is variable. Accordingly, the over all cycle time for a particular field or group of fields of the precipitator may be varied in accordance with the rapping needs of that particular field or group of fields. Moreover, the rapping intensity may be controlled in accordance with rapping requirements through adjustment of the intensity control circuit 42 or the resistor 20. The rapper controller in accordance with the present invention is therefore quite versatile and may be utilized in various rapping applications.

Figure 5:
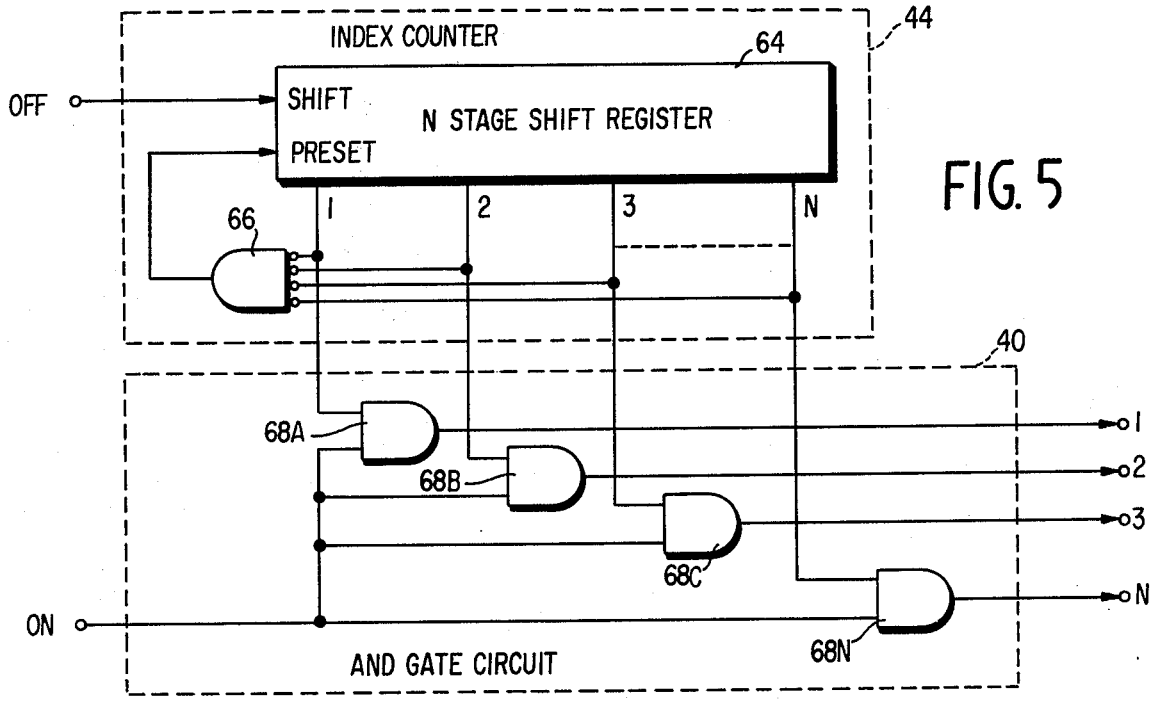
FIG. 5 is a more detailed functional block diagram of the index counter and AND gate circuit of FIG. 3.
Figure 6:
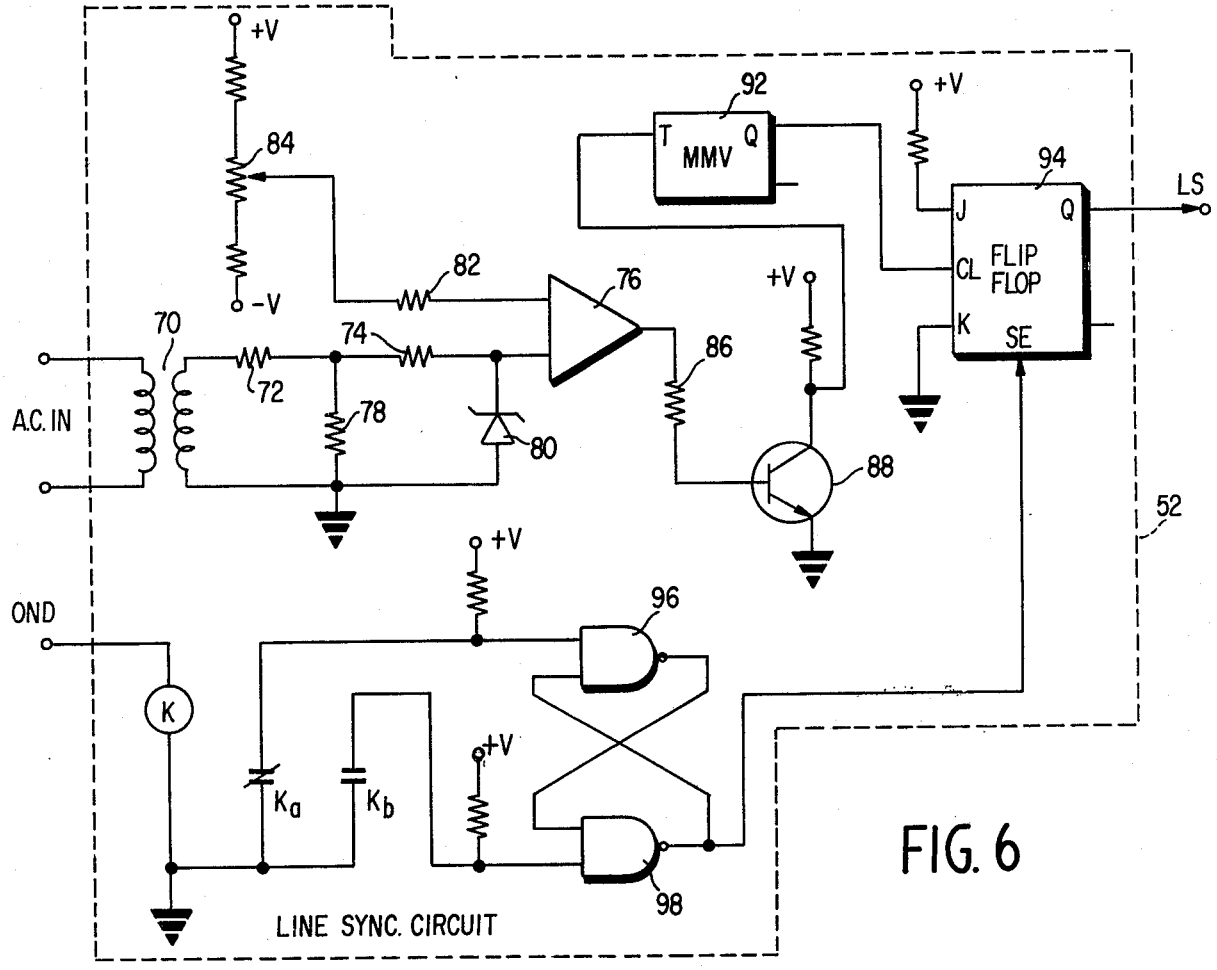
FIG. 6 is a more detailed functional block diagram of the line sync circuit of FIG. 3.
Figure 7:
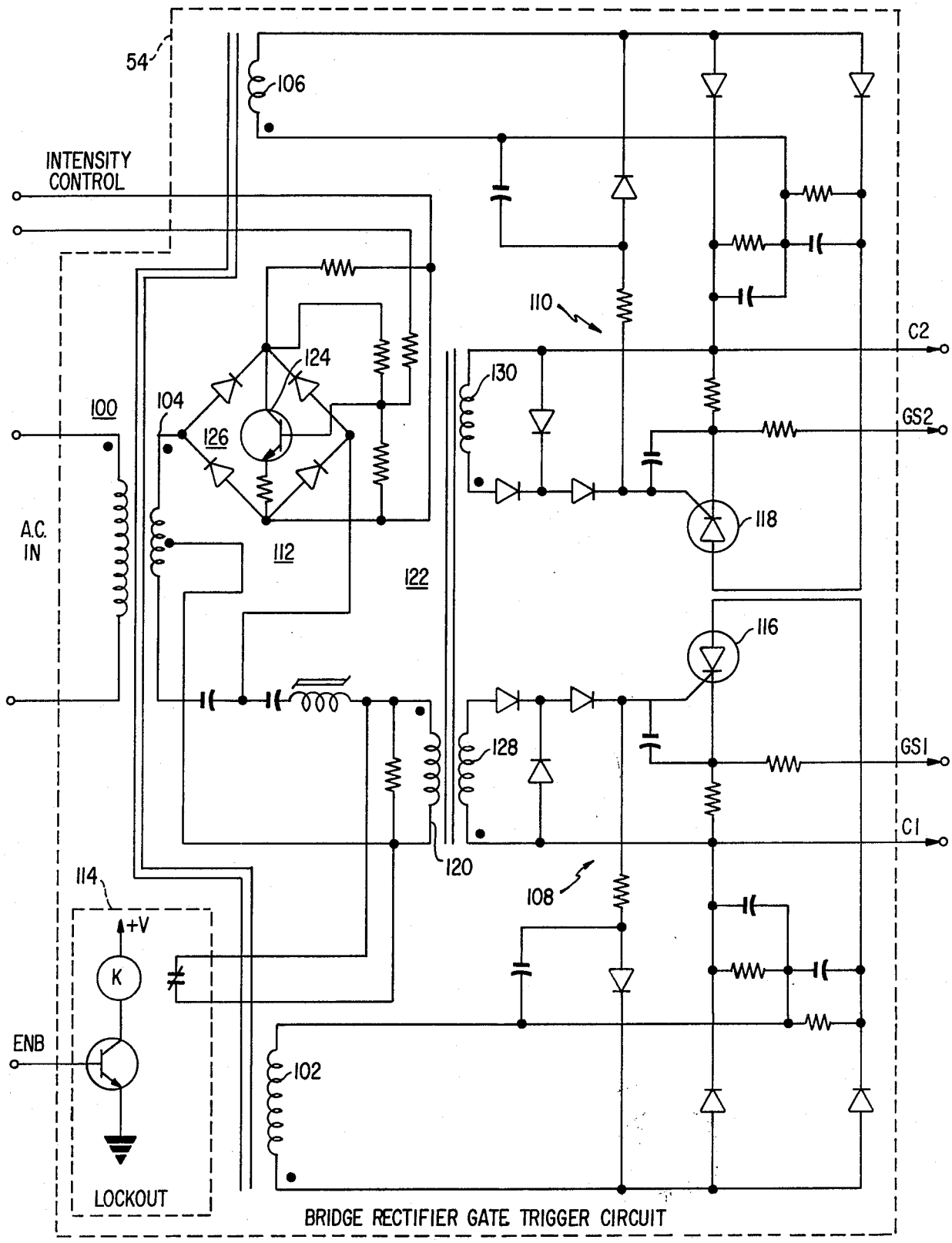
FIG. 7 is a schematic diagram illustrating the bridge rectifier gate trigger circuit of FIG. 3 in greater detail; and, FIG. 8 is a view in partial cross-section of a rapper assembly in accordance with the present invention.

To further facilitate an understanding of the present invention, the index counter 44 and AND gate circuit 40, the line sync circuit 52, and the bridge rectifier gate trigger circuit 54 are illustrated in greater detail in FIGS. 5, 6 and 7, respectively.

Referring now to FIG. 5, the index counter 44 may include an N stage shift register 64 and the OFF signal from the off timer 36 may be applied to the shift input terminal of the register 64. The 1–N output signals from the register 64 may be applied to an N terminal NAND gate 66, the output signal from which may be applied to the preset input terminal of the register 64. The 1–N output signals from the shift register 64 may also be supplied to respective AND gates 68A–68N in the AND gate circuit 40. The ON signal from the on timer 34 of FIG. 3 may be supplied to the other input terminal of each of the AND gates 68A–68N.

In operation, the ON signal from the on timer 34 enables all of the AND gates in the AND circuit 40 so as to, in effect, sample the present condition of each stage of the shift register 64. Assuming, for example, that the third state of the shift register 64 contains a binary ONE, the "3" signal will be passed by the AND gate 68C and supplied to the SCR relay driver and level translator circuit 46 of FIG. 3.

When the ON signal assumes a low or binary ZERO signal level inhibiting the AND gates 68A–68N, the OFF signal provides a shift pulse to the shift register 64 and the binary ONE in the shift register 64 is shifted into the next stage thereof. For example, after the contents of the shift register 64 have been sampled and a three signal has been generated as was previously described, the next OFF pulse shifts the binary ONE signal in the third stage of the shift register 64 into the fourth stage thereof. When the next ON pulse occurs and the AND gates 68A–68N are enabled the output signal from the AND gate circuit 40 will therefore be a 4 output signal and SCR 4 will be gated on.

As the binary ONE signal in the shift register 64 is shifted therethrough, the binary ONE is eventually shifted out of the last stage and all of the stages contain a binary ZERO. This condition is sensed by the NAND gate 66 and a preset pulse is generated to preset the first stage of the register 64 to a binary ONE thereby beginning a new indexing cycle. The index counter and AND gate circuit thereby continuously generate SCR gating signals in a timed sequence in response to the ON and OFF signals from the timers 34 and 36.

Referring now to FIG. 6, wherein the line sync circuit 52 of FIG. 3 is illustrated in greater detail, the a.c. input signal from the isolation transformer 14 is applied to the input winding of a transformer 70. One side of the output winding of the transformer 70 is grounded and the other side is connected through series resistors 72 and 74 to the input terminal of a suitable conventional comparator 76. A resistor 78 may be connected between the resistor 72, resistor 74 junction and ground, and a zener diode 80 may be connected between the input terminal of the comparator 76 and ground for protection of the comparator. A reference input terminal of the comparator 76 may be connected through a current limiting resistor 82 to the arm of the potentiometer 84 in a voltage divider network as illustrated.

The output signal from the comparator 76 may be supplied through a current limiting resistor 86 to the base electrode of a suitable NPN transistor 88 having its emitter electrode grounded and its collector electrode connected to a positive voltage source through a load resistor 90. The collector electrode of the transistor 88 may be connected to the trigger input terminal T of a conventional monostable or one-shot multivibrator 92 and the binary ONE or true output terminal of the multivibrator 92 may be connected to a clock input terminal CL of a flip-flop 94. The J input terminal of the flip-flop 94 may be connected to a positive voltage source through a resistor 96 and the K input terminal thereof may be grounded. The output signal from the true output terminal Q of the flip-flop 94 may be provided as the line sync output signal LS to the enable gate 60 as previously described in connection with FIG. 3.

The on delayed or OND signal from the delay circuit 38 of FIG. 3 is supplied through a relay coil K to ground and one side of the respective normally open and normally closed contacts $K_a$–$K_b$ of the relay coil K are connected to ground. The other side of the normally closed relay contact $K_a$ is connected to one input terminal of a two input terminal NAND gate 96 and through a resistor to a positive voltage source. The other side of the normally open relay contact $K_b$ is connected to one input terminal of a two input terminal NAND gate and through a resistor to the positive voltage source. The output terminal of the NAND gate 97 is connected to the other input terminal of the NAND gate 98 and the output terminal of the NAND gate 98 is connected to the other input terminal of the NAND gate 96. The NAND gates 96 and 98 thereby form a bistable latching circuit and provide an output signal from the output terminal of the NAND gate 98 to the set enable or SE input terminal of the flip-flop 94.

In operation, the amplitude of the a.c. input signal is compared by the comparator 76 with a reference voltage provided from the potentiometer 84. Each time the absolute value of the a.c. signal goes below a value determined by the reference signal, the transistor 88 is triggered into conduction and the multivibrator 92 is thus triggered providing a clock signal to the flip-flop 94.

The flip-flop 94 remains in a reset condition until enabled by an appropriate set enable signal. In this connection, the on delay signal from the delay circuit 38 energizes the relay coil K, opening the contact $K_a$ and closing the contact $K_b$. When the contact $K_b$ is closed, the latch formed by the NAND gates 96 and 98 changes states and the output signal from the NAND gate 98 assumes a high signal level enabling the flip-flop 94 to be set. The next zero cross-over of the a.c. input signal subsequent to the initiation of the on delay signal OND therefore sets the flip-flop 94 providing a line sync signal LS to the enable gate 60 as described in connection with FIG. 3. Accordingly, the line sync signal LS is a pulse commencing at the first zero cross-over of the a.c. input signal after the initiation of the on delay signal OND.

Referring now to FIG. 7, wherein the bridge rectifier gate trigger circuit 54 of FIG. 3 is illustrated in greater detail, the a.c. input signal from the isolation transformer 14 is applied to the input winding of a transformer 100 having output windings 102, 104 and 106. The output winding 102 of the transformer 100 is connected to a gating signal generator circuit generally indicated at 108 and the output winding 106 is connected to a gating signal generator circuit generally indicated at 110. The output winding 104 of the transformer 100 is connected to a trigger signal generator circuit generally indicated at 112 and the circuit 112 supplied trigger signals to the gating signal generator circuits 108 and 110 as will hereinafter be described in greater detail.

The intensity control signal from the intensity control circuit 42 of FIG. 3 is supplied to the trigger signal generator circuit 112 to control the phase relationship between the a.c. input signal and the generated trigger signals. The enable signal ENB from the enable gate circuit 60 of FIG. 3 is supplied to a lockout circuit 114 to control the operation of the trigger signal generator circuit 112 and to inhibit operation of other controllers during rapper energization as was previously described.

Each of the gating signal generator circuits 108 and 110 preferably includes, a silicon controlled rectifier 116 and 118, respectively, which generate the respective gating signals GS1 and GS2 when triggered. During the positive half cycle of the a.c. input signal, the SCR 116 is forward biased by the voltage developed across the output winding 102 and the SCR 118 is reversed biased by the voltage developed across the output winding 106. Similarly, the SCR 118 is forward biased and the SCR 116 is reversed biased during each negative half cycle of the a.c. input signal. Accordingly, the gating signal GS1 may be generated during each positive half cycle of the a.c. input signal if the SCR 116 is triggered during the positive half cycle. The gating signal GS2 may be generated during each negative half cycle of the a.c. input signal if the SCR 118 is triggered during the negative half cycle.

The triggering of the SCR's 116 and 118 is controlled by the trigger 112. In the absence of an enable signal ENB, a relay coil K in the lockout circuit 114 is deenergized and the normally closed contacts of the relay K remain closed. These relay contacts are connected across an input winding 120 of a transformer 122, shorting the input winding 120 when the contacts are closed. The trigger circuit 112 is thus inhibited from generating trigger signals in the absence of the enable signal ENB.

When the enable signal ENB energizes the relay K in the lockout circuit 114, the relay contacts of the relay K are opened for the duration of the enable signal, thereby enabling the generation of trigger signals by the trigger signal generator 112. During each half cycle of the a.c. input signal, the enabled trigger signal generator 112 develops a trigger signal across the input winding 120 of the transformer 122. The intensity control signal determines the initial bias on the base electrode of an NPN transistor 124 in a bridge circuit 126 connected to the output winding 104 of the transformer 100. A trigger signal is supplied to the input winding 120 of the transformer 122 at the point in each half cycle at which the intensity control bias is overcome and the transistor 124 is triggered into conduction. Accordingly, the intensity control signal determines the time in each half cycle at which the trigger signals are generated by the trigger signal generator 112. With the illustrated arrangement, the generation of the trigger signals may be varied from a phase angle of 0°–90° within each half cycle.

The trigger signal supplied to the input winding 120 of the trigger signal generator 112 are coupled to output windings 128 and 130 of the transformer 122. Trigger signals occurring during each positive half cycle of the a.c. input signal result in the triggering of the SCR 116 which, as was previously described, is forward biased during each positive half cycle. Similarly, trigger signals generated during each negative half cycle of the a.c. input signal result in the triggering of the SCR 118 which is forward biased during each negative half cycle. Accordingly, gating signals GS1 and GS2 are generated during the respective positive and negative half cycles of the a.c. input signal at a point in the half cycle determined by the intensity control signal and over a period of time determined by the duration of the enable signal ENB. The gating signals GS1 and GS2 are referenced to the respective common or return points C1 and C2 and may be employed to trigger the SCRs 28 and 30, respectively, in the controlled d.c. supply 16 of FIG. 3 as was described previously.

With the rapper energization technique illustrated and described in connection with FIG. 3–7, power supplied to the rapper coils is at a relatively low voltage and at a relatively high current, e.g. up to 75 amps. Accordingly, the rappers are preferably constructed as illustrated in FIG. 8 in order to provide effective rapping energy in response to the low voltage-high current supply.

Figure 8:
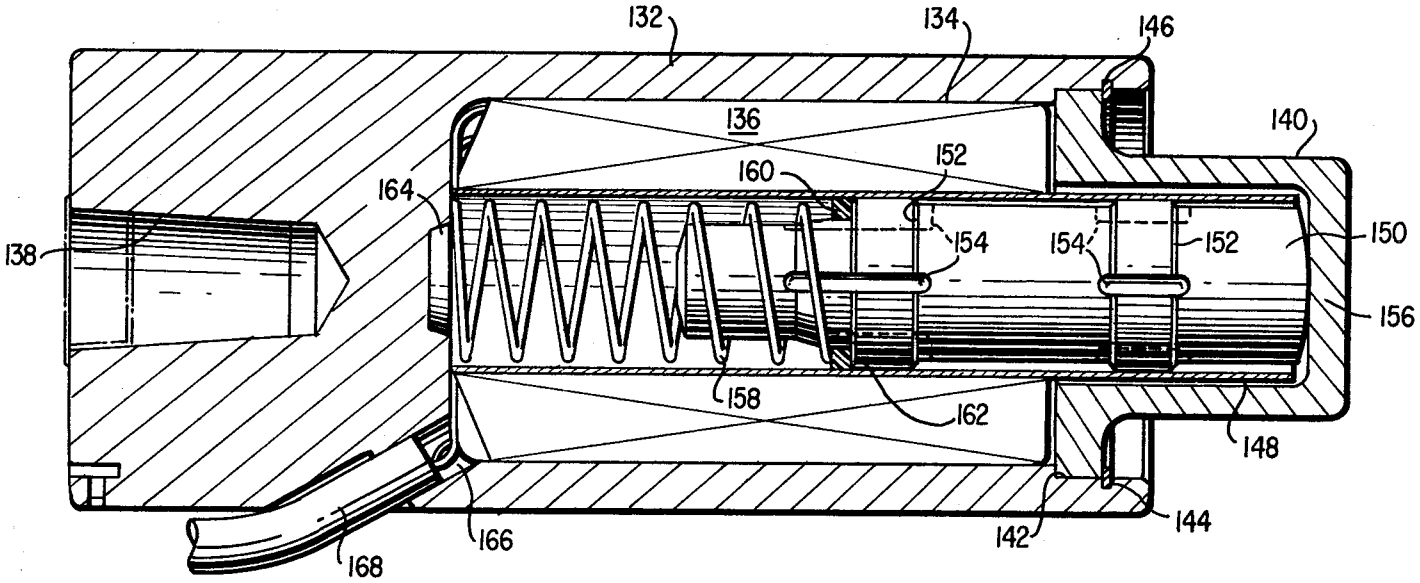

Referring now to FIG. 8 wherein a preferred embodiment of a rapper suitable for use with a control system of the present invention is illustrated, the rapper includes a cylindrical body member 132 having an axial bore 134 in one end thereof to receive an insulated coil 136 of conductor wire. The body member 132 is provided with a tapered, axial bore 138 at the other end thereof for mounting on rapping rods (not shown) which transmit the mechanical rapping energy to the precipitator plates and the like.

A cylindrical, hat shaped end cap 140 encloses the bore 134 and is held in place against an annular shoulder 142 of the bore 134 by a retaining ring 144 disposed in an annular grove 146 formed within the bore 134. A cylindrical guide tube or sleeve 148, preferably fabricated from brass, is inserted into the interior of the coil 136 in the bore 134 and provides a guide for a generally cylindrical rapper piston 150. The rapper piston 150 includes two axially spaced annular guide surfaces 152 which project radially outwardly and guide the piston 150 as it travels axially within the sleeve 148. Each of the annular guide surfaces 152 is provided with a plurality of air slots 154 providing for the free flow air from one section of the sleeve 148 to all other sections thereof as the piston 150 travels along the sleeve 148.

The body member 132 and the end cap 140 are preferably formed from low carbon hot rolled steel which has excellent magnetic properties. The piston 150 which preferably fabricated from ductile iron containing deposits of free graphite. The ductile iron has excellent magnetic properties and the graphite serves to provide a permenant lubrication media.

The piston 150 is biased outwardly from the interior of the coil 136 and against an end wall 156 of the cap 140 by a spring 158. One end of the spring 158 abutts the bottom or end wall of the bore 136 and the other end of the spring 158 abutts a shock absorbing ring 160 made of neoprene or other suitable shock absorbing material which in turn abutts a shoulder 162 formed radially on the piston 150. An insert 164 of stainless steel or other suitable nonmagnetic material is provided at the end or bottom of the bore 134 to receive the impact of the piston 150 when the rapper coil is energized and to ensure that the piston 150 is not held against the end of the bore by residual magnetism. The body member 132 is also bored as indicated at 166 to receive a cable 168 carrying energizing current to the coil 136.

The coil 136 is preferably wound with relatively heavy wire (e.g. No. 11 wire) and a relatively small number of current carrying loops. This coil construction results in an ability to receive high current impulses (on the order of 75 amps) without damage to the coil and with the production of a sufficient amount of magnetic flux to saturate the piston 150 and the surrounding metal parts, thereby causing an intense piston impact. The relatively small amount of d.c. coil resistance i.e. about 1.2 ohms, permits this large current flow without causing overheating as would be the case with prior art rappers having about 1000 ohms d.c. coil resistance.

In operation, when current flows through the coil 136 a magnetic field is created around the coil and tending to draw the piston 150 into the coil 136. Because of the excellent magnetic properties of the body member 132, the end cap 140 in its illustrated position despite such continued impacting. Moreover, there may be a tendency for the spring 158 to bounce when the piston 150 has been returned to its illustrated biased position. The shock absorber 160 absorbs any shock imparted to the spring by such bouncing and prevents breakage of the end of the spring that might otherwise occur.

It can thus be seen that the rapper illustrated in FIG. 8 provides an intense impact in response to the high current, low voltage impulses supplied from the rapper controller previously described. Moreover, the rapper assembly is constructed in a manner which provides for a long service life under extremely adverse ambient conditions such as those typically encountered at a precipitator installation.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A controller for selectively energizing actuating coils of rappers of an electrostatic precipitator assembly to impart motion to a portion of the precipitator assembly and remove accumulated material therefrom, the controller comprising:

a rapper supply bus common to a plurality of the actuating coils of the rappers of the electrostatic precipitator assembly;

a return bus common to a plurality of the actuating coils of the rappers of the electrostatic precipitator assembly;

rectifying means for selectively rectifying an a.c. supply voltage and supplying a d.c. potential to said rapper supply bus;

a first switch means operatively connected to the rectifying means;

a plurality of second electronic switching means each operatively connected to an associated one of said plurality of actuating coils to selectively effect the individual connection of such actuating coil of said associated one of said plurality of actuating coils between said common rapper supply bus and said common return bus; and, control circuit means connected to said first and second electronic switching means to control the operation thereof, said control circuit means including means for applying a first gating signal of a predetermined duration to said first electronic switching means to thereby supply said d.c. potential to the rapper supply bus and means responsive to the presence of said d.c. potential on said common supply bus for selectively supplying a second gating signal to at least one of said plurality of second electronic switching means during at least a portion of the duration of said first gating signal to thereby effect the connection of a selected one of said plurality of actuating coils between said common rapper supply bus and said common return bus with said d.c. potential supplied to said common rapper supply bus.

2. The controller of claim 1 wherein said first and second electronic switching means comprise silicon controlled rectifiers each having gate electrodes for receiving the associated ones of said first and second gating signals from said control circuit means.

3. The controller of claim 1 wherein said control circuit means includes:

means for periodically generating a pulse signal of a predetermined duration;

means responsive to said pulse signal for generating said second gating signal and applying said second gating signal to said at least one of said second electronic switching means; and, means responsive to said pulse signal and said a.c. supply voltage for initiating said first gating signal at a zero cross-over of said a.c. supply voltage subsequent to the start of said second gating signal.

4. The controller of claim 1 wherein said rapper supply bus is common to a plurality of actuating coils of rappers in a single precipitator field.

5. The controller of claim 1 wherein said rapper supply bus is common to a plurality of actuating coils of rappers in more than one precipitator field.

6. The controller of claim 1 wherein said control circuit means includes:

means for periodically generating a pulse signal of a predetermined duration; and, means for selectively supplying said second gating signal to said at least one of said second electronic switching means in response to the simultaneous presence of a pulse signal and said d.c. potential on said rapper supply bus.

7. The controller of claim 1 including a second controller and means for supplying to said second controller a lockout signal coextensive with and in time synchronization with said first gating signal.

8. The controller of claim 1 wherein each of said second electronic switching means comprises a plurality of silicon controlled rectifiers, each of said silicon controlled rectifiers being connected in series with an associated one of said rapper actuating coils between said rapper supply bus and said common return bus, and each of said silicon controlled rectifiers having a gate electrode individually connected to said control circuit means.

9. The controller of claim 8 wherein said control circuit means comprises:

means for generating a series of pulses each of a predetermined duration;

means for generating said second gating signal in response to each pulse of said series of pulses and for successively applying said generated second gating signal to a different one of said plurality of silicon controlled rectifiers to thereby successively energize each of said rapper actuating coils in time sequence.

10. The controller of claim 9 wherein said rapper supply bus is common to a plurality of actuating coils of rappers in a single precipitator field.

11. The controller of claim 9 wherein said rapper supply bus is common to a plurality of actuating coils of rappers in more than one precipitator field.

12. A controller for selectively energizing actuating coils of rappers of an electrostatic precipitator assembly to impart motion to a portion of the precipitator assembly and remove accumulated material therefrom, the controller comprising:

a rapper supply bus common to a plurality of the actuating coils of the rappers of the electrostatic precipitator assembly;

means for intermittently supplying a d.c. potential to the rapper supply bus for the time periods each of a predetermined duration; and means responsive to the d.c. potential of said supplying means for selectively connecting at least one actuating coil of said plurality of actuating coils to said rapper supply bus during each of said time periods to energize such actuating coil with said d.c. potential.

13. The controller of claim 12 wherein said supplying means includes means for selectively varying a time interval between successive of said time periods during which said d.c. potential is supplied to said rapper supply bus.

14. The controller of claim 12 wherein said rapper supply bus is common to a plurality of actuating coils of rappers in a single precipitator field.

15. The controller of claim 12 wherein said rapper supply bus is common to a plurality of actuating coils of rappers in more than one precipitator field.

16. The controller of claim 12 including a second controller and means for supplying to said second controller a lockout signal coextensive with and in time synchronization with said first gating signal.

17. The controller of claim 12 wherein said supplying means includes controlled switching means for rectifying an a.c. voltage and supplying said d.c. potential to said supply bus over variable conduction periods, and means for varying the conduction periods of said controlled switching means so as to vary the current available from said rapper supply bus.

18. The controller of claim 12 wherein said supplying means includes means for generating a series of spaced pulses of said predetermined duration and means for supplying said d.c. potential to said rapper supply bus in response to each of said pulses.

19. The controller of claim 18 wherein said supplying means includes means for selectively varying the spacing between said spaced pulses.

20. The controller of claim 12 wherein said supplying means includes:

means for generating a first series of spaced pulses;

means responsive to each pulse of said series of spaced pulses for generating a gating pulse of said predetermined duration and commencing subsequent to the start of said pulse of said series of pulses;

means for supplying said d.c. potential to said rapper supply bus in response to said gating pulse; and, wherein said connecting means includes means responsive to said d.c. potential on said rapper supply bus and to said series of spaced pulses for connecting said at least one actuating coil to said rapper supply bus.

21. The controller of claim 20 wherein said supplying means includes means for selectively varying the spacing between said spaced pulses.

22. The controller of claim 21 wherein said rapper supply bus is common to a plurality of actuating coils of rappers in a single precipitator field.

23. The controller of claim 21 wherein said rapper supply bus is common to a plurality of actuating coils of rappers in more than one precipitator field.

* * * * *